United States Patent [19]

Jozens

[11] 4,307,505

[45] Dec. 29, 1981

[54] CUTTER-PRESSER FOR 710 CONNECTOR

[75] Inventor: Victor Jozens, Venice, Calif.

[73] Assignee: Communications Technology Corporation, Los Angeles, Calif.

[21] Appl. No.: 85,392

[22] Filed: Oct. 16, 1979

[51] Int. Cl.[3] ..... H01R 43/04

[52] U.S. Cl. ..... 29/566.4; 29/566.3; 29/749; 29/753

[58] Field of Search ..... 29/566.3, 566.1, 566.4, 29/564.6, 564.7, 564.8, 749, 753

[56] References Cited

U.S. PATENT DOCUMENTS 3,772,635 11/1973 Frey et al. ..... 339/99 R 4,148,138 4/1979 Becker et al. ..... 29/566.3

OTHER PUBLICATIONS

Handbook for the 710 Connector.

*Primary Examiner*—William R. Briggs

[57] ABSTRACT

A cutter-presser for making connections to an electric cable connector of the type used in splicing telephone cable. A cutter-presser for receiving an index strip, seating conductors in the index strip and cutting the conductors, mounting a connector module on the index strip, seating conductors in the connector module and cutting the conductors, and mounting a cap on the conductor module. A cutter-presser with a T-bar for movement into position on an index strip or connector module or cap and a cam system for moving the T-bar linearly toward the body of the unit with stops for selectively limiting such motion depending upon the component being handled.

8 Claims, 23 Drawing Figures

62
30
56
89
96
90
93
95
94
80
98
97
82
50
101
102
91
92
34

CUTTER-PRESSER FOR 710 CONNECTOR

BACKGROUND OF THE INVENTION

This invention relates to a cutter-presser for cable connectors and specifically to a cutter-presser suitable for use with the cable connector utilized by the telephone companies and known as the 710 connector.

Cable connectors of this type are shown in U.S. Pat. No. 3,772,635. A typical connector has an index strip, a connector module, and a cap and provides for interconnecting 25 pairs of conductors. In use, the conductors from a first cable are inserted in the index strip and uniformly cut off. The connector module is then attached to the index strip and the conductors from a second cable are similarly inserted in the connector module and uniformly cut off. A cap is provided on the connector module. The connector may utilize a fourth component known as a bridge module to provide a T-connection for a third cable, with the cable conductors being fastened in the bridge module and the bridge module being mounted on the connector module.

A tool for pressing conductors into the index strip, cutting the conductors, pressing the connector module onto the index strip, pressing conductors into the connector module, cutting the conductors, and pressing the cap onto the connector module is shown in said U.S. Pat. No. 3,772,635. The 710 connector and an alternative form of tool is shown in the Handbook for the 710 Connector.

Problems have been encountered in the past with the tool used in connection with the 710 connector, this tool usually being referred to as a cutter-presser. The cutter-presser has a body in which the connector is positioned, and a T-bar carried on the body and positioned over the connector, with some mechanism for moving the T-bar and body toward each other at the connector. One prior art tool utilizes a spring loaded mechanism in the body for engaging the T-bar, which mechanism causes the tool to jam at times.

It is an object of the present invention to provide a new and improved cutter-presser utilizing a direct drive cam mechanism for moving the T-bar with respect to the body, with the T-bar being moved along a straight line during the pressing and cutting operation.

Another problem encountered with the prior art tool arises from the fact that the T-bar tends to fall away from the body and it is an object of the present invention to provide a new and improved construction utilizing a counter-balancing spring for controlling the relative positions of the body and T-bar.

Problems have sometimes been encountered in maintaining the connector firmly positioned in the body during and after pressing and cutting operations and it is a further object of the present invention to provide a new and improved configuration for connector mounting.

These and other objects, advantages, features, and results will more fully appear in the course of the following description.

SUMMARY OF THE INVENTION

The cutter-presser of the present invention includes a body, a T-bar pivotally mounted on the body and movable upwardly and downwardly relative to the body, with the body having spaced T-bar guides engageable by the T-bar. The tool further includes cam means movable upwardly and downwardly relative to the body and connected to the T-bar for moving the T-bar downwardly in the T-bar guides, lever means connected to the cam means for pivoting the cam means to move the T-bar upwardly and downwardly relative to the body, location dog means connected to the cam means and pivotable by the lever means, and a series of stop means carried on the body and sequentially engageable by the dog means for limiting downward movement of the T-bar for operation with each of the three components of the connector.

DESCRIPTION OF THE PREFERRED EMBODIMENTS

Figure 1:
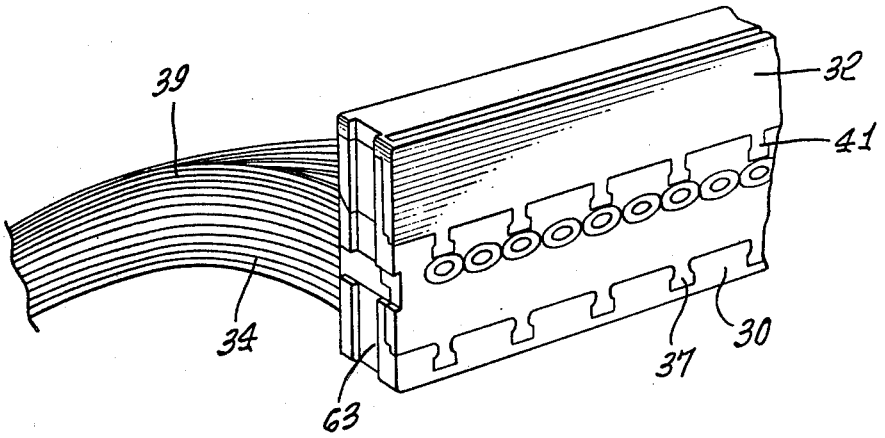
FIG. 1 is a perspective view of a 710 electric cable connector with the three portions joined together and with two cables connected thereto.
Figure 2:
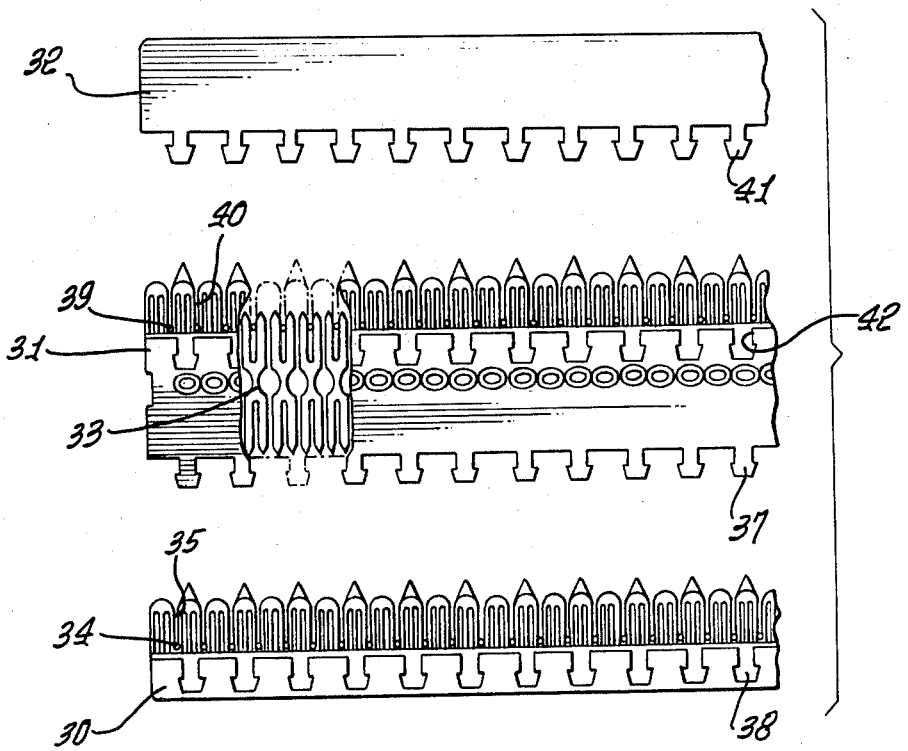
FIG. 2 is a side view showing the three components of the 710 connector separately.
Figure 14:
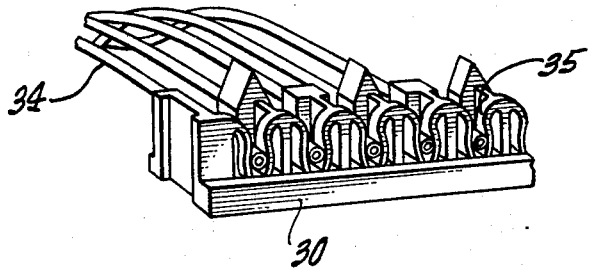
FIG. 14 is a view similar to that of FIG. 9 showing the index strip with the conductors in position and cut off.

The connector shown in FIGS. 1 and 2 includes an index strip 30, a connector module 31, and a cap 32. These three components are molded plastic pieces, with metal contact elements 33 carried within the connector module 31. Conductors 34 from a first cable are positioned in slots 35 in the index strip by the workman making the cable connection. The cutter-presser tool is then used to press the conductors to the bottoms of the slots to the condition shown in FIG. 9, and then cut off the free ends of the conductors, as shown in FIG. 14. Next the connector module is positioned on the index strip, with legs 57 pressed into slots 38 and with the lower ends of the metal contacts 33 making electrical contact with corresponding conductors 34.

Figure 16:
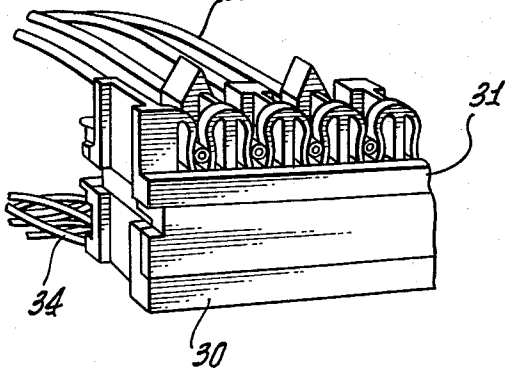
FIG. 16 is a view similar to that of FIGS. 9 and 14 showing the connector module on the index strip with the conductors cut off in the connector module.

Conductors 39 from a second cable are positioned in grooves 40 of the connector module and are pressed down and cut off in the same manner as with the index strip, producing the configuration shown in FIG. 16, with the conductors engaging the upper ends of the metal contacts 33. Finally, the cap 32 is pressed onto the connector module 31 with legs 41 of the cap placed into corresponding slots 42 of the connector module, producing the finished product of FIG. 1.

The cutter-presser tool includes a body 50 and a T-bar 51. See FIGS. 3–8 and 18. The body 50 typically is an aluminum casting and may be provided with a support leg 52 threaded into a boss 53 on the body and held in place by a lock nut 54. A cavity 55 is provided in the body 50 for the T-bar operating mechanism (to be described hereinbelow), and the cavity is closed by a cover plate 56 attached to the body by several screws.

Means are provided on the upper end of the body 50 for receiving the connector components and the T-bar. Two vertical guide members 59 are attached at opposite sides of the body 50 by screws and project upward from the body, each including a groove 60 for slidingly receiving a guide plate 61 carried in the T-bar 51, which guide plate also serves as a holder for cutting blades 62.

The connector components 30, 31, 32 have aligned grooves 63 (FIG. 1) at each end. A rib 64 is provided on one guide member 59 and a spring 65 having the configuration of the rib 64 is provided on the other guide member 59, and a trough 66 is provided in the upper end of the body 50. The index strip 30 is slid downward between the guide members 59 with the grooves 63 engaging the rib 64 and spring 65 and with the lower end of the index strip resting in the trough 66. The spring 65 urges the strip against the opposite guide member.

Clamp means are provided for securing retaining the index strip in the body and in the embodiment illustrated includes two spaced L-clips 68 carried on a bar 69 in turn carried by a pin 70, with the upper ends of the clips positioned in recesses 71 of the body 50.

Figure 6:
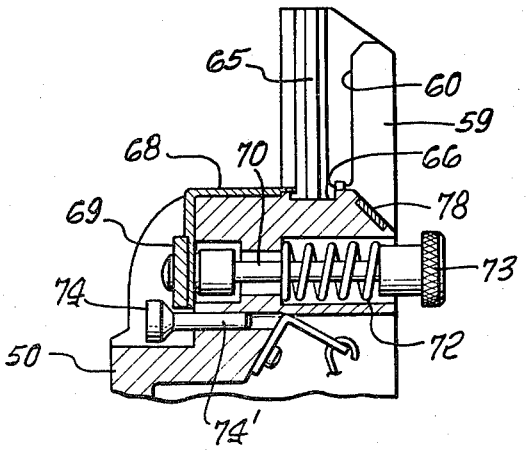
FIG. 6 is a sectional view taken along the line 6—6 of FIG. 5.
Figure 7:
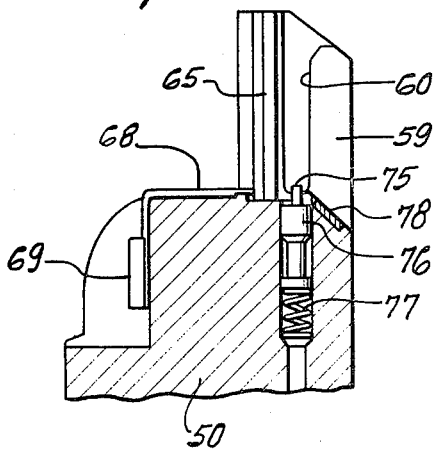
FIG. 7 is a sectional view taken along the line 7—7 of FIG. 5.
Figure 8:
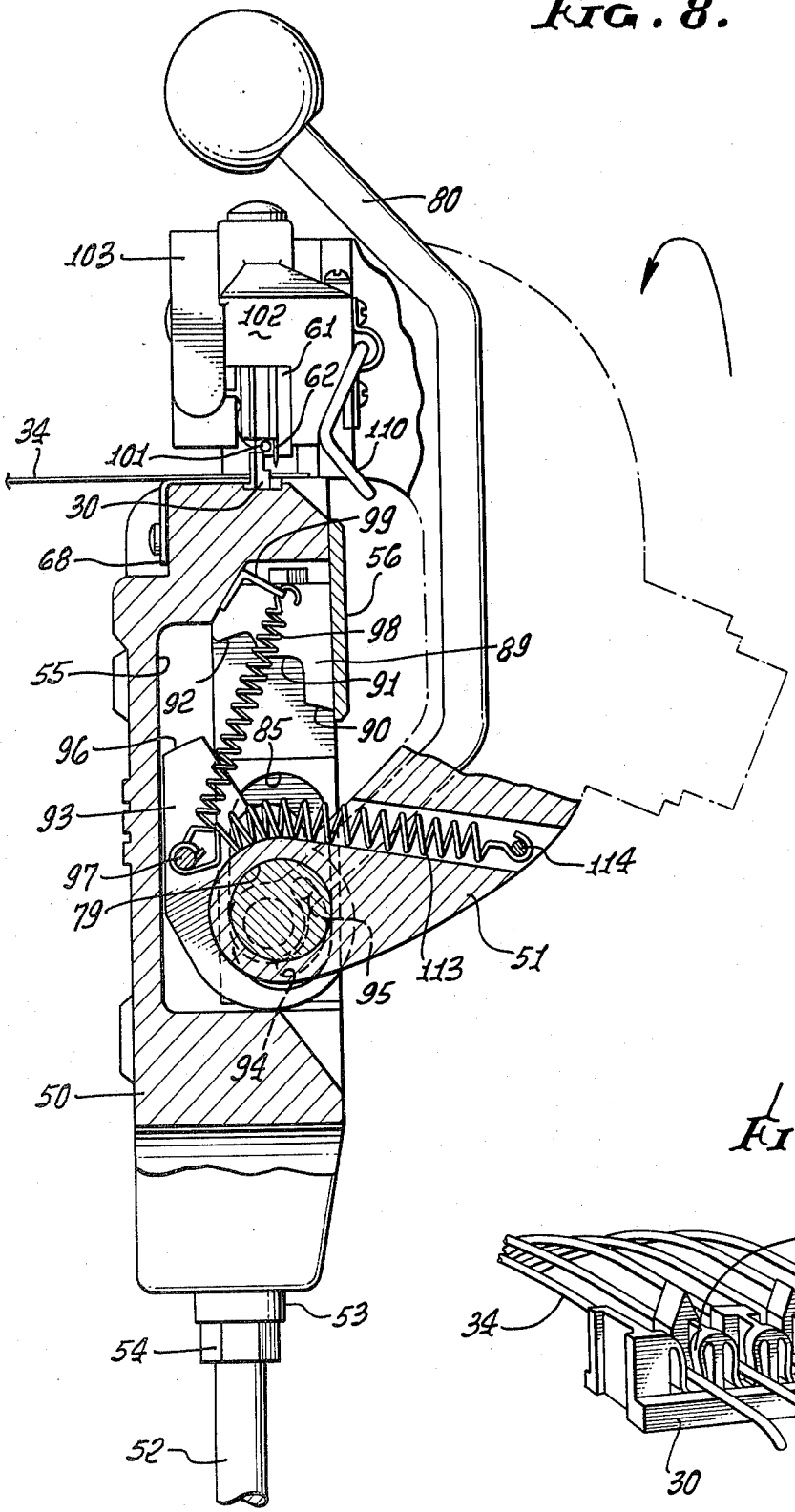
FIG. 8 is a view similar to that of FIG. 3, partly in section, with an index strip mounted in the body and with the T-bar in position over the index strip.

A spring 72 about the pin 70 between a shoulder in the body and a head 73 of the pin urges the pin to the right as viewed in FIG. 6, seating the clips in the recesses of the body. The clips are raised by manually pushing in on the head 73 which brings the bar 69 into engagement with tapered end 74 of pin 74' affixed in the body 50, lifting the clips away from the body. In use, the index strip is placed in position between the vertical guide members 59 and is manually pushed downward at the same time, the head 73 is pushed in to move the clip out of interference with the index strip, permitting the index strip to rest on the trough 66, as seen in FIG. 8. Then the head 73 is released and the spring 72 seats the clips 68 on the body 50 with the ends of the clips engaging grooves in the index strip, as seen in FIG. 8, securely holding the index strip in the body.

Retainer pins 75 are carried in plugs 76 pushed into openings in the body 50, with springs 77 urging the pins upward. When an index strip 30 is seated in the body, the edge of the strip opposite the clips 68 engages the pins 75 to retain the strip. These pins are spring loaded to remain in the position shown, but will retract to prevent interference when using the cutter-presser with a bridge module.

A coded strip 78, preferably marked in color segments, is carried in a groove in the body parallel to the index strip trough 66, with the top surface of the code strip flush with the body.

The T-bar 51 typically has an aluminum casting as its major component and is mounted in the body on a pin 79 which provides for pivoting and translation of the T-bar relative to the body. The T-bar is pivoted from the position of FIG. 3 to the position of FIG. 8 by manually moving the T-bar upward. When the guide plate 61 is engaged with the grooves 60 of the vertical guide members 59, the lever 80 is moved downward as shown in FIGS. 10–13 to move the T-bar downwardly in a straight line. The lever 80 has a hub 81 which is pinned to a shaft portion 82 of the pin 79.

The shaft portion 82 of the pin 79 is eccentric with respect to the central portion 83, and cams 84 are pinned to opposite extensions of shaft portion 82. The cams 84 ride in slots 85 of guide plates 86 which are mounted to the body 50. Stop members 89 are also mounted to the body 50 and each stop member is provided with three stop surfaces 90, 91, 92, best seen in FIG. 8.

Two dogs 93 ride on shaft portions 82 of the pin 79, with each dog having an arcuate groove 94 for receiving a pin 95 projecting from the central portion 83 of the pin 79. Each dog has an upper surface 96 for engaging the stop surfaces 90, 91, 92, and the dogs are joined to each other by a pin 97. Springs 98 are connected between the pin 97 and a bracket 99 carried on the body 50. The springs 98 urge the dogs into engagement with the stop surfaces, while the pins 95 block movement of the dogs toward the stop surfaces.

The guide plate 61, the cutting blades 62 and a contact plate 101 are held between the cross bar section 102 of the T-bar and a cover plate 103 by suitable screws. The contact plate 101 has a plurality of vertical fingers which are appropriately spaced to engage the grooves 35, 40 of the components of the connector, pressing the conductors down in the grooves when the tool is activated. Also, these fingers of the contact plate 101 preferably are of electrical conducting material and electrically insulated from each other for making electrical contact with the contact elements 33 and thereby providing access to the connector strip. Conductors from the individual elements of the contact plate are fed through a conduit 104 to a cable connector 105 carried in a housing 106 mounted on the T-bar.

As described previously, the guide plate 61 carried on the cross bar section 102 of the T-bar 51 slides vertically in grooves 60 of the vertical guide members 59 carried at the upper end of the body 50. Also, the cover plate 103 projects laterally from each side of the cross bar section 102 for sliding engagement with the vertical surface 109 of the vertical guide members 59 for guiding the downward and upward motion of the T-bar relative to the body.

Figure 3:
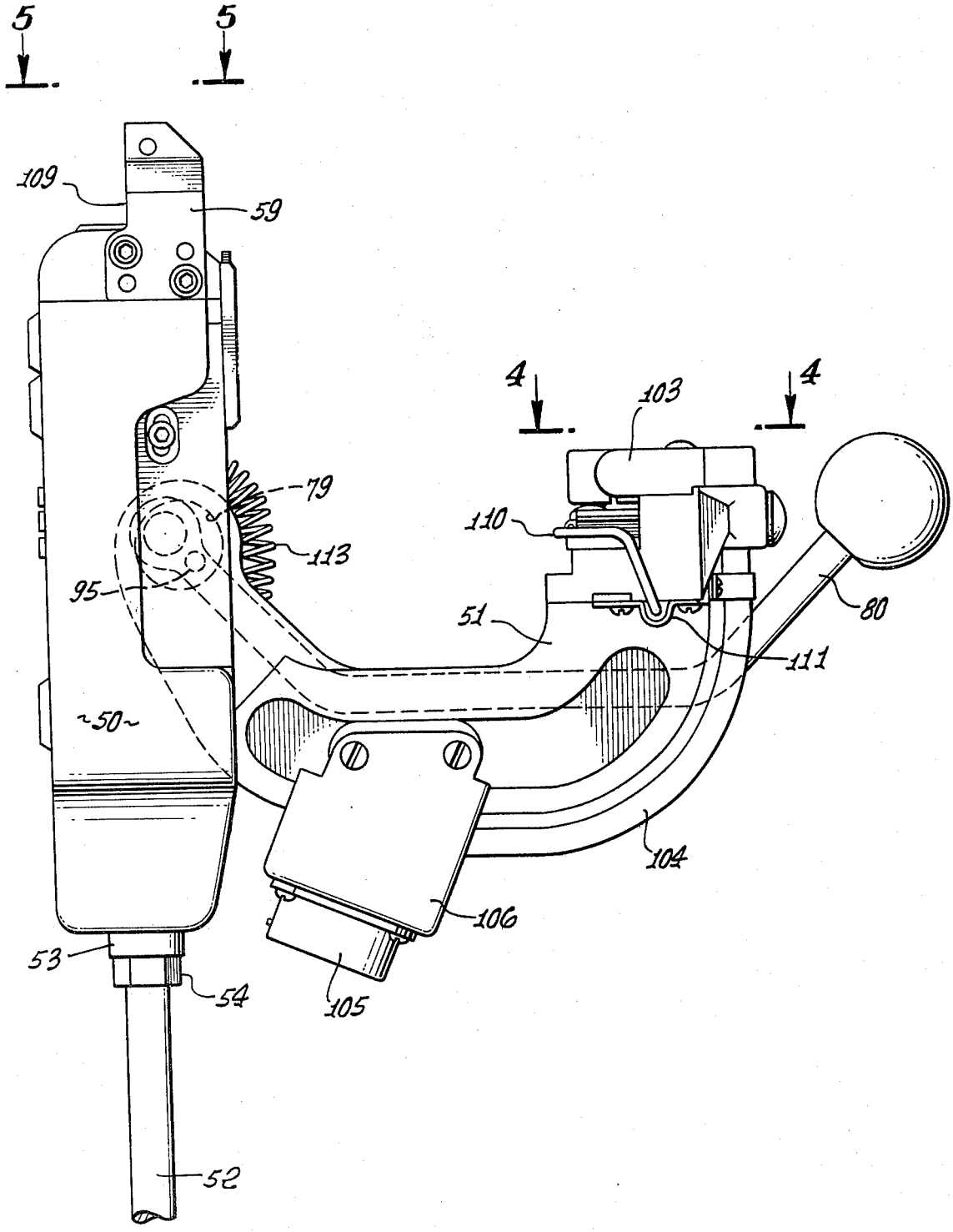
FIG. 3 is a side view of a cutter-presser incorporating the presently preferred embodiment of the invention.
Figure 4:
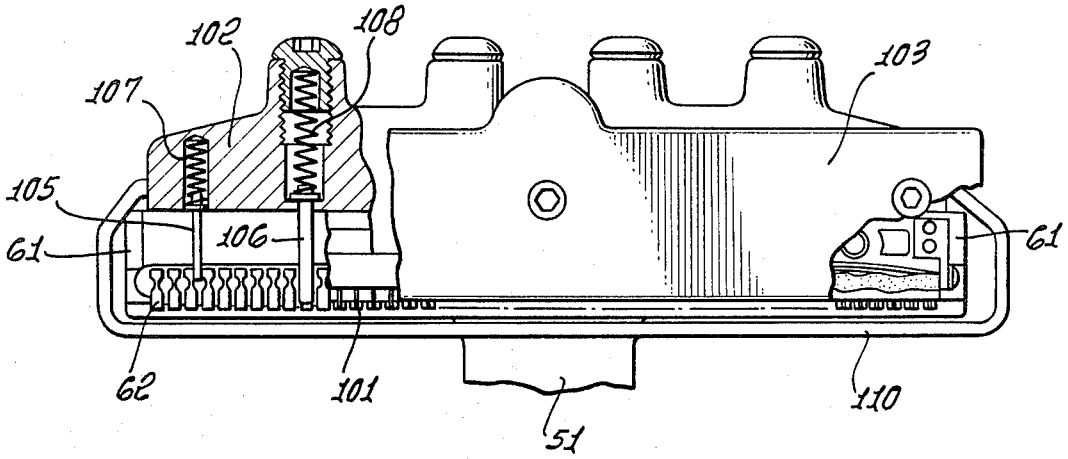
FIG. 4 is a top view of the T-bar, partly in section, taken along the line 4—4 of FIG. 3.
Figure 5:
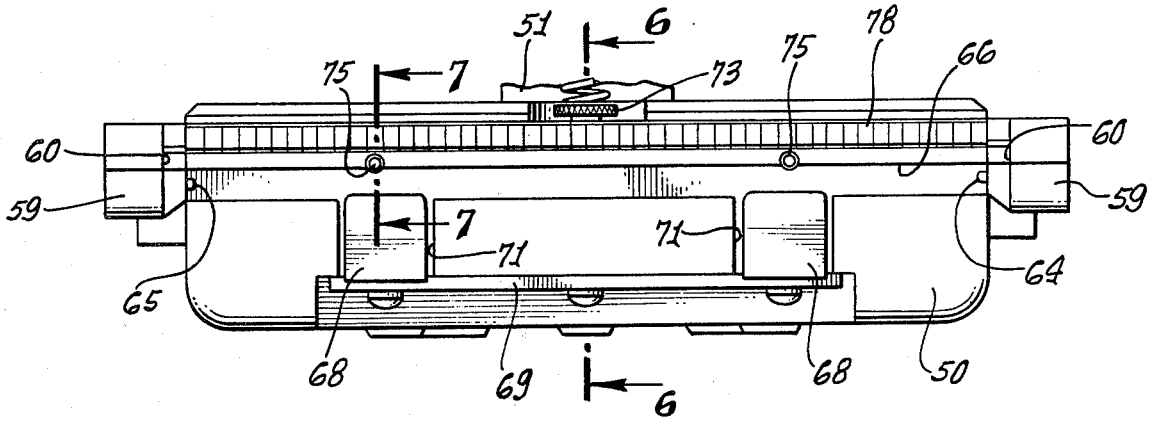
FIG. 5 is a top view of the body taken along the line 5—5 of FIG. 3.

A blade protector 110 is pivotally mounted in supports 111 and spring loaded to the position shown in FIGS. 3 and 4 for protecting the cutting blades 62 from damage and for protecting the operator from the cutting blades. When the T-bar is raised to the position of FIG. 8, the blade protector 110 engages the vertical guide members 59 and is pivoted away from the blades to the position shown in FIG. 8. A spring loaded clamp 112 is carried on the cross bar section 102 for holding the lever 80 in the up position as shown in FIGS. 3 and 8 and in phantom lines in FIG. 18. The lever may be manually pulled out of the clamp and manually pressed into the clamp as desired. A counter balance spring 113 is fastened between the pin 97 interconnecting the dogs 93 and a pin 114 carried in the T-bar 51. This spring provides a force counterbalancing the weight of the T-bar when in the upright position as shown in FIGS. 3 and 8, so that the T-bar may be manually moved to the desired position and will tend to remain in such position, rather than always falling downward under the force of gravity to the position of FIG. 3.

A plurality of ejector pins 105, 106 are mounted in the T-bar (FIG. 4), with springs 107, 108 urging the pins outward for disengaging the elements of the T-bar from a connector.

Figure 9:
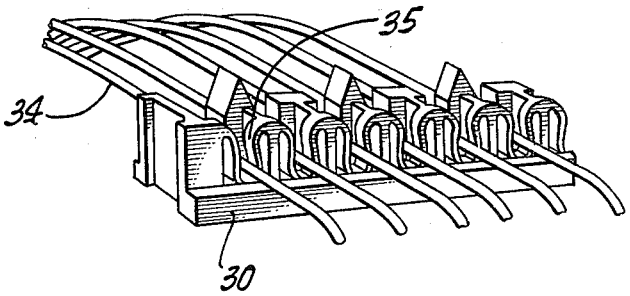
FIG. 9 is a perspective view of the index strip of FIG. 8 with the conductors positioned therein.

In operation, the cutter-presser is opened to the position of FIG. 3 and an index strip 30 is inserted between the vertical guide members 59 and clamped in place by the clips 68, as shown in FIG. 8. Then conductors are positioned in appropriate grooves in the index strip as shown in FIG. 9 and the T-bar is pivoted upward to the position of FIG. 8 and the guide plate 61 is inserted into the upper ends of the grooves 60 of the vertical guide members 59. The tool is now in the position shown in FIG. 8.

Figures 10, 11, 12:
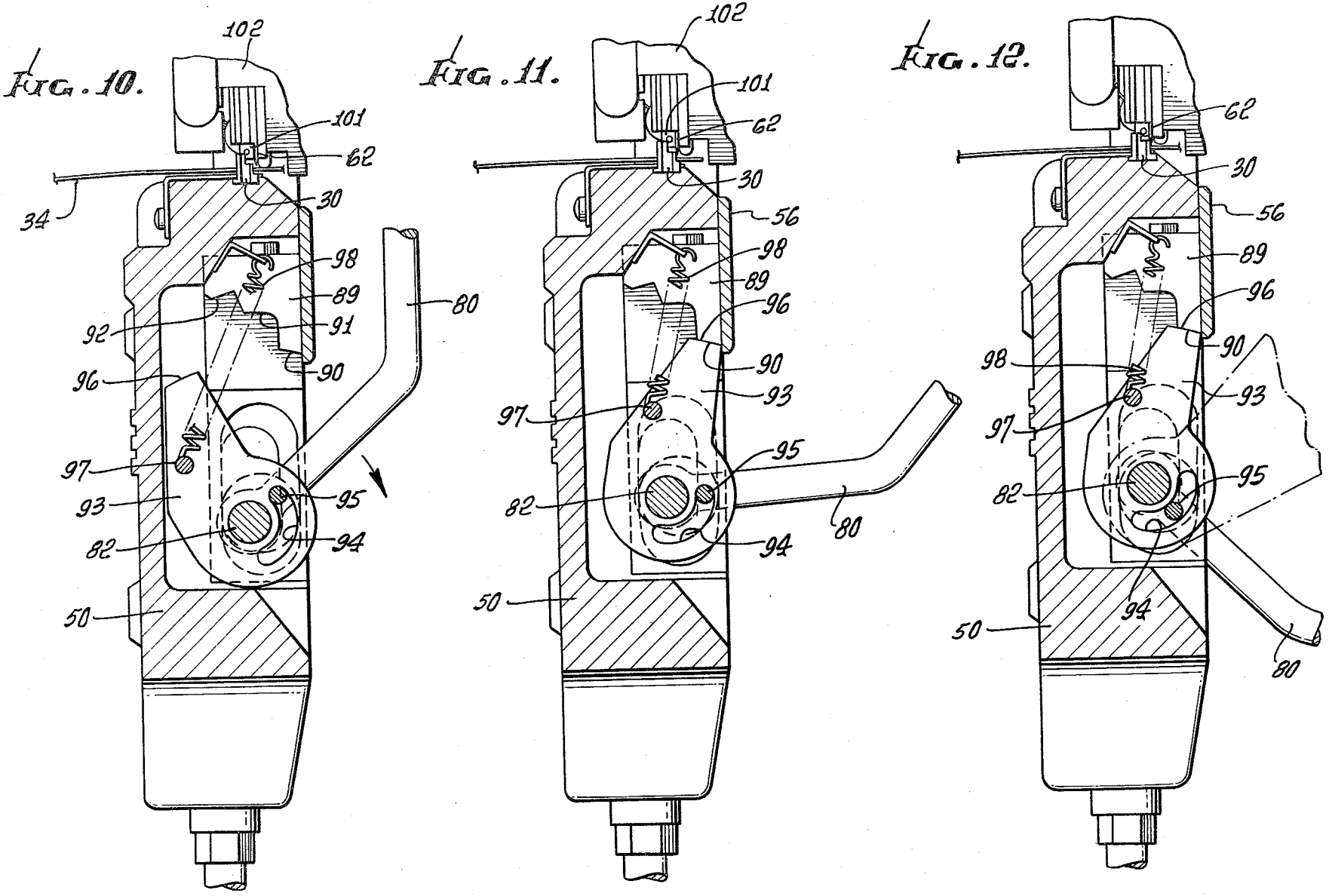
FIGS. 10, 11 and 12 are views similar to that of FIG. 8 showing the operating lever in three sequential positions.
Figure 13:
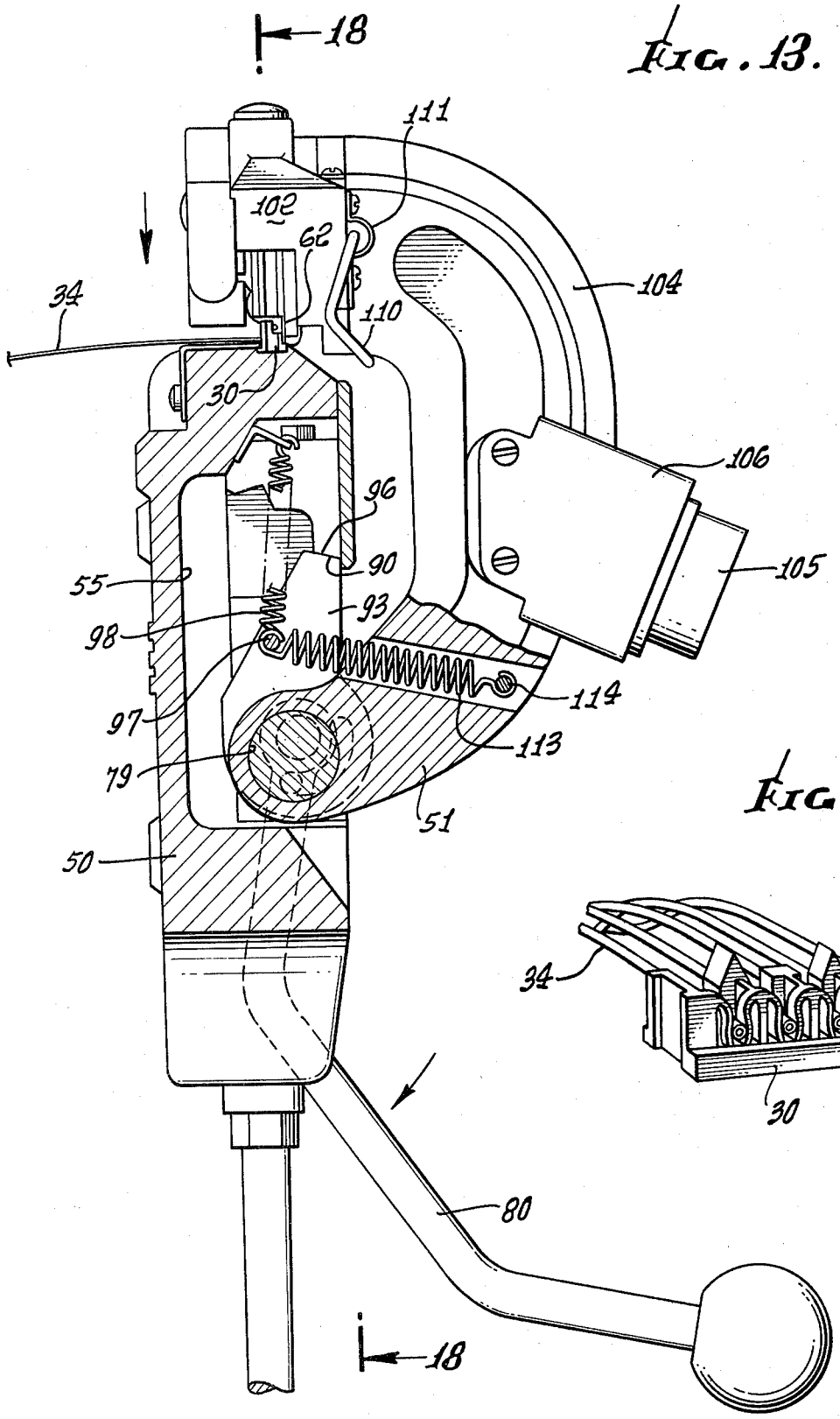
FIG. 13 is a view similar to that of FIG. 8 showing the lever and the extreme downward position with the cutting operation completed.
Figure 15:
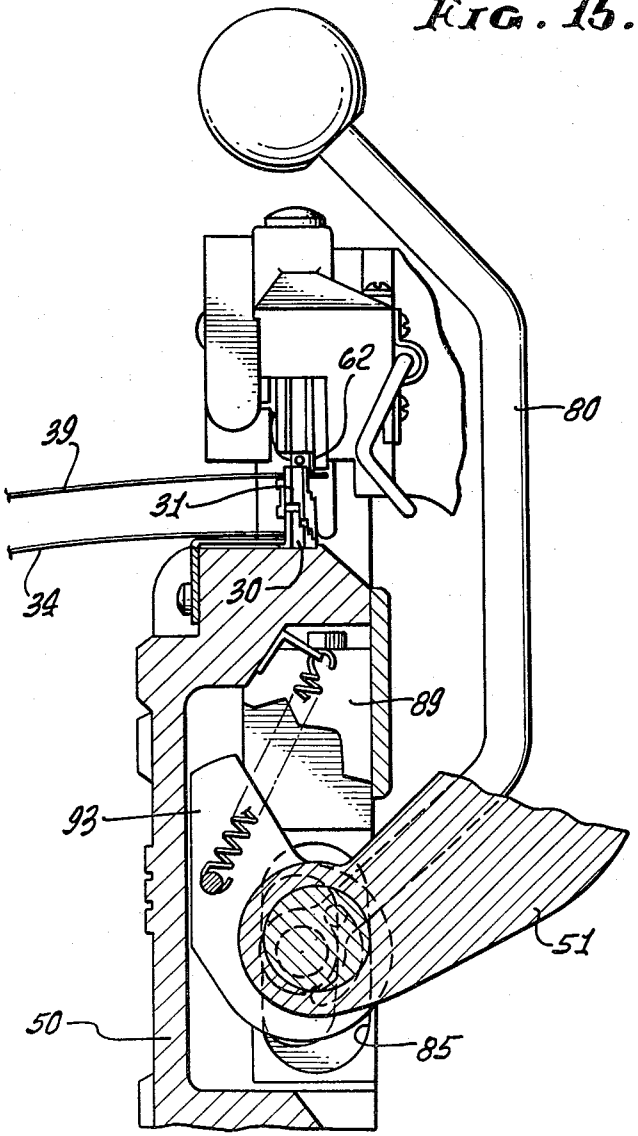
FIG. 15 is a view similar to that of FIG. 8 showing the connector module in position.
Figure 18:
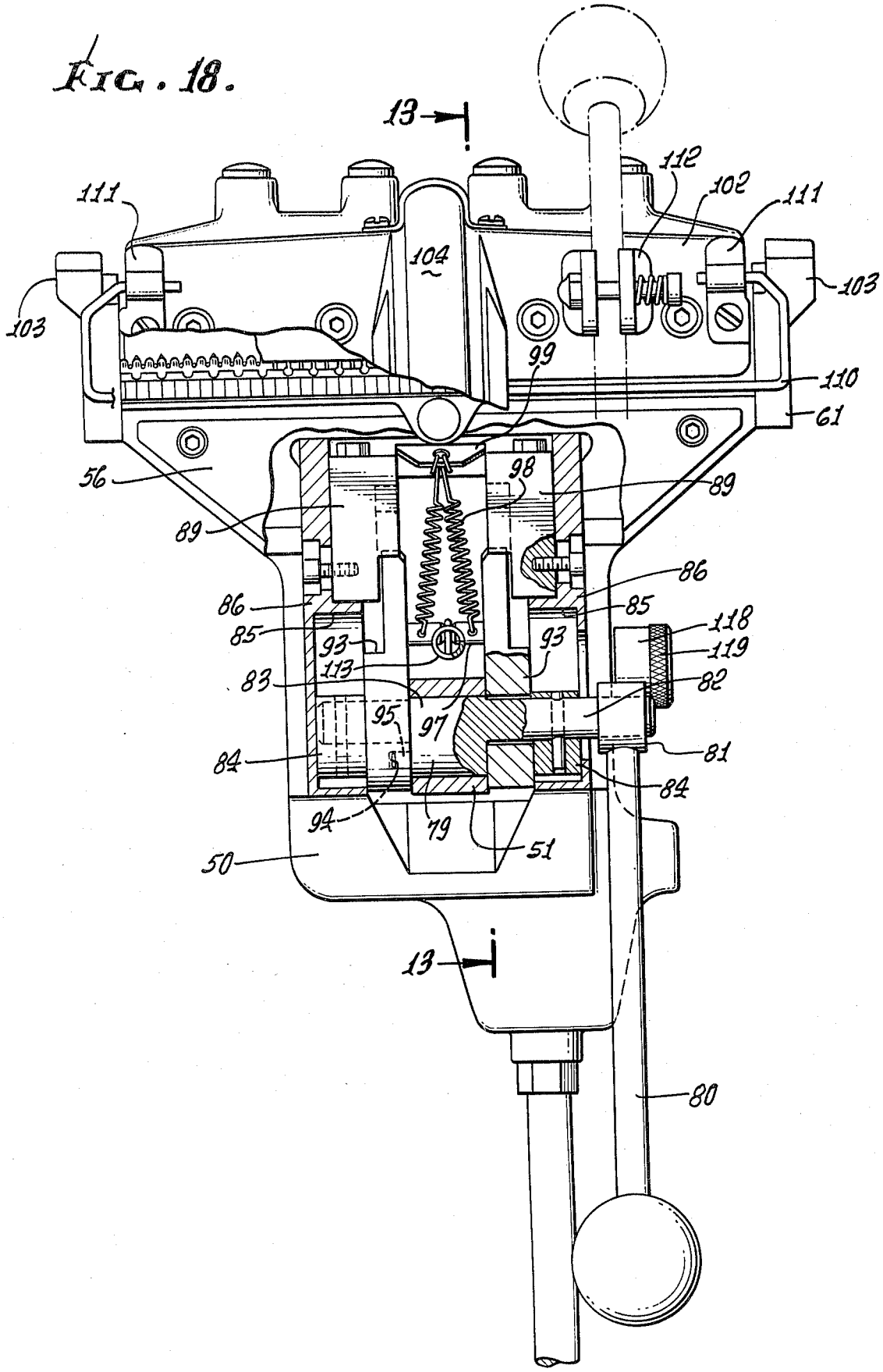
FIG. 18 is a sectional view taken along the line 18—18 of FIG. 13.

The lever 80 is pulled out of the clamp 112 and is pivoted downward through the positions of FIGS. 10, 11, 12 and 13. As the lever rotates the cams 84, the T-bar is moved vertically downward bringing the elements of the contact plate 101 into the groove of the index strip firmly positioning the conductors in the grooves and then bringing the cutting blades 62 into engagement with the conductors, cutting off the conductors at the index strip. Also as the lever 80 is moved downward or clockwise as seen in the Figures, the pin 95 moves clockwise permitting clockwise rotation of the dogs 93 as urged by the springs 98. As seen in FIG. 11, the dogs continue to rotate until the dog surfaces 96 engage the stop surfaces 90, which engagement serves as a limit on the downward movement of the T-bar relative to the body. The lever is moved downward to the limit of its travel as shown in FIG. 13, producing the product of FIG. 14. The lever is then returned to the up clamped position, the T-bar is moved out of engagement with the body, and is moved downward to the position of FIG. 3. The connector module 31 is now inserted in position over the index strip and the T-bar is moved upward to the position of FIG. 15. The lever is again moved downward, moving the T-bar downward on the body and pressing the connector module into the index strip. However since the T-bar is higher with respect to the body because of the presence of the connector module 31, when the lever rotates releasing the dog, the dog engages the stop surface 91 rather than the stop surface 90 and limits the downward movement of the T-bar to that required for the combination of index strip and connector module. The lever is then raised to the upper position and the T-bar is moved out of engagement with the body. The conductors 39 are now positioned in the connector module, the T-bar is raised and engaged with the body, and the lever is moved downward to cut off the conductors 39, again as shown in FIG. 15, leaving the product of FIG. 16.

Figure 17:
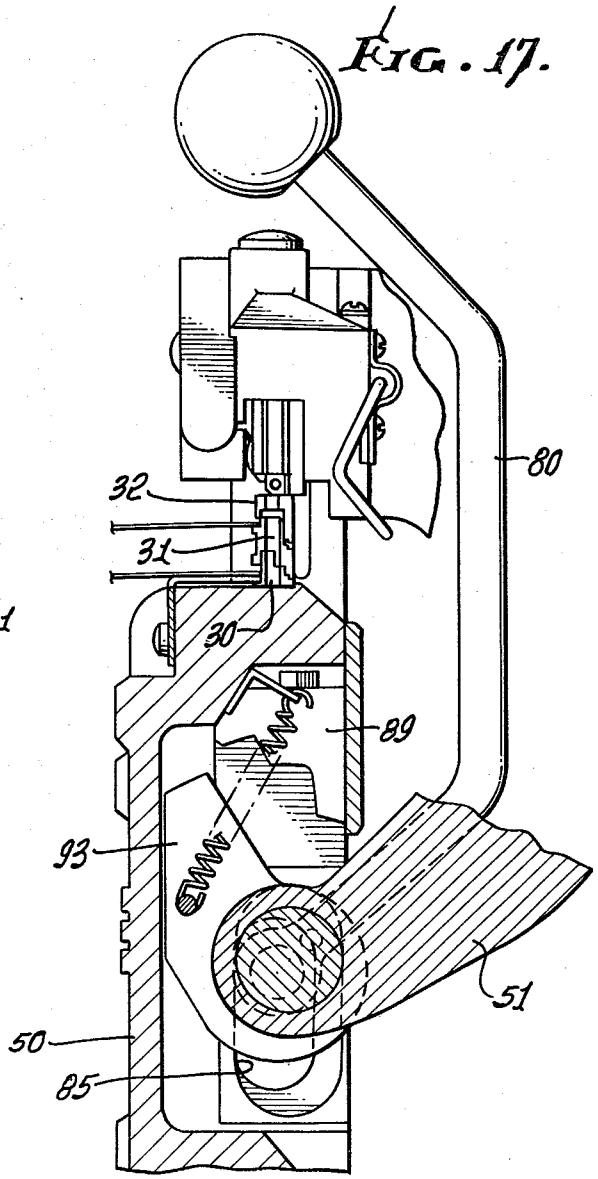
FIG. 17 is a view similar to that of FIGS. 8 and 15 with the cap in position.

With the tool again in the open position of FIG. 3, the cap 32 is positioned on the connector module, the T-bar is moved upward into position over the cap as shown in FIG. 17, and the lever is again moved down, pressing the cup onto the connector module to produce the finished unit of FIG. 1. Now with the T-bar again further up with respect to the body, the dogs when released engage the stop surfaces 92 again limiting the downward movement of the T-bar relative to the body to the desired amount. The lever is moved up and clamped, the T-bar is moved out of engagement with the body, and the completed connector is removed from the body.

Figure 19:
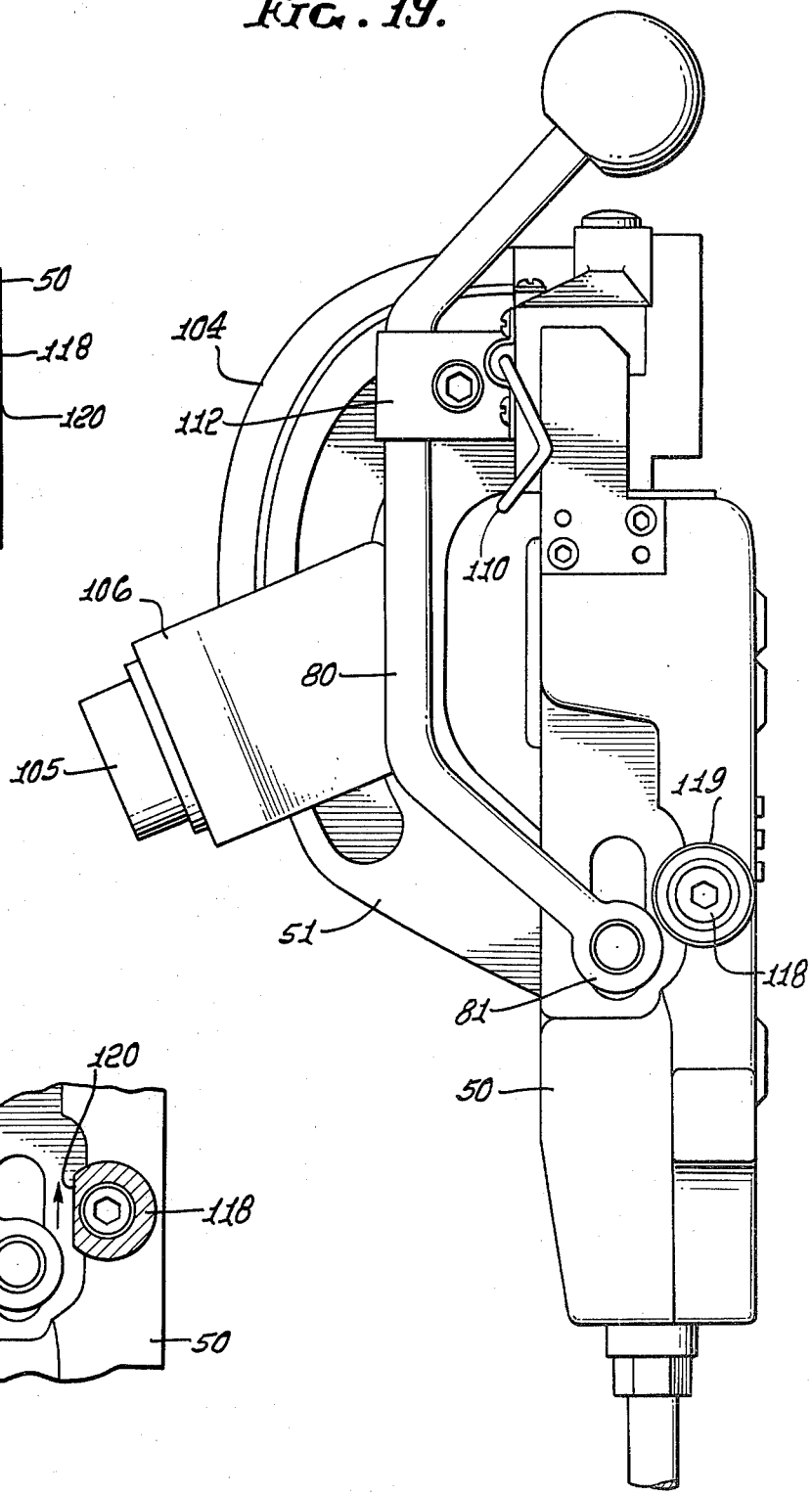
FIG. 19 is a view similar to that of FIG. 8, taken from the opposite side.
Figure 20:
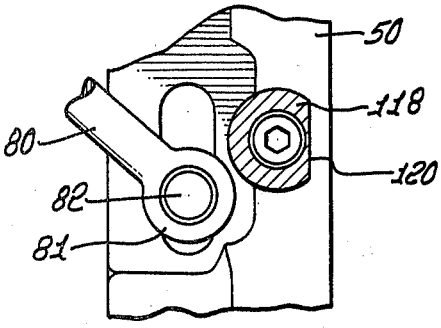
FIG. 20 is a partial view similar to that of FIG. 19 showing the lever locking knob in the locking position.
Figure 21:
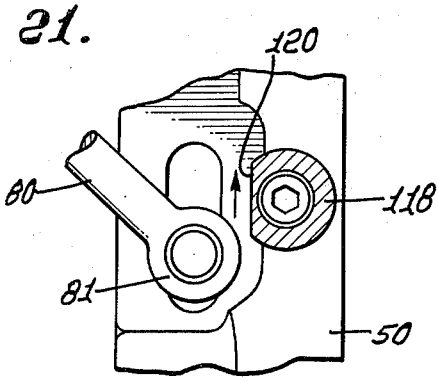
FIG. 21 is a view similar to that of FIG. 20 showing the lever locking knob in the free position.

Provision is made for locking the T-bar in engagement with the body as shown in FIG. 19. A knob 118 is mounted on the body for rotation, as by a knurled rim 119. The knob 118 is positioned to be an interference fit with the hub 81 of the lever 80 as the T-bar moves vertically relative to the body, as shown in FIG. 20. The knob is provided with a relieved section 120 which can be rotated from the position of FIG. 20 to the position of FIG. 21 providing clearance for the hub of the lever. Under normal conditions, the knob is maintained in the position of FIG. 21 permitting the T-bar to be pivoted upward over the body and then moved vertically downward engaging the T-bar guide plate with the body guide members. After the T-bar is moved downward to the position of FIGS. 19 and 21, the knob can be rotated to the position of FIG. 20 thereby preventing upward movement of the T-bar and hence disengagement of the T-bar from the body.

Figure 22:
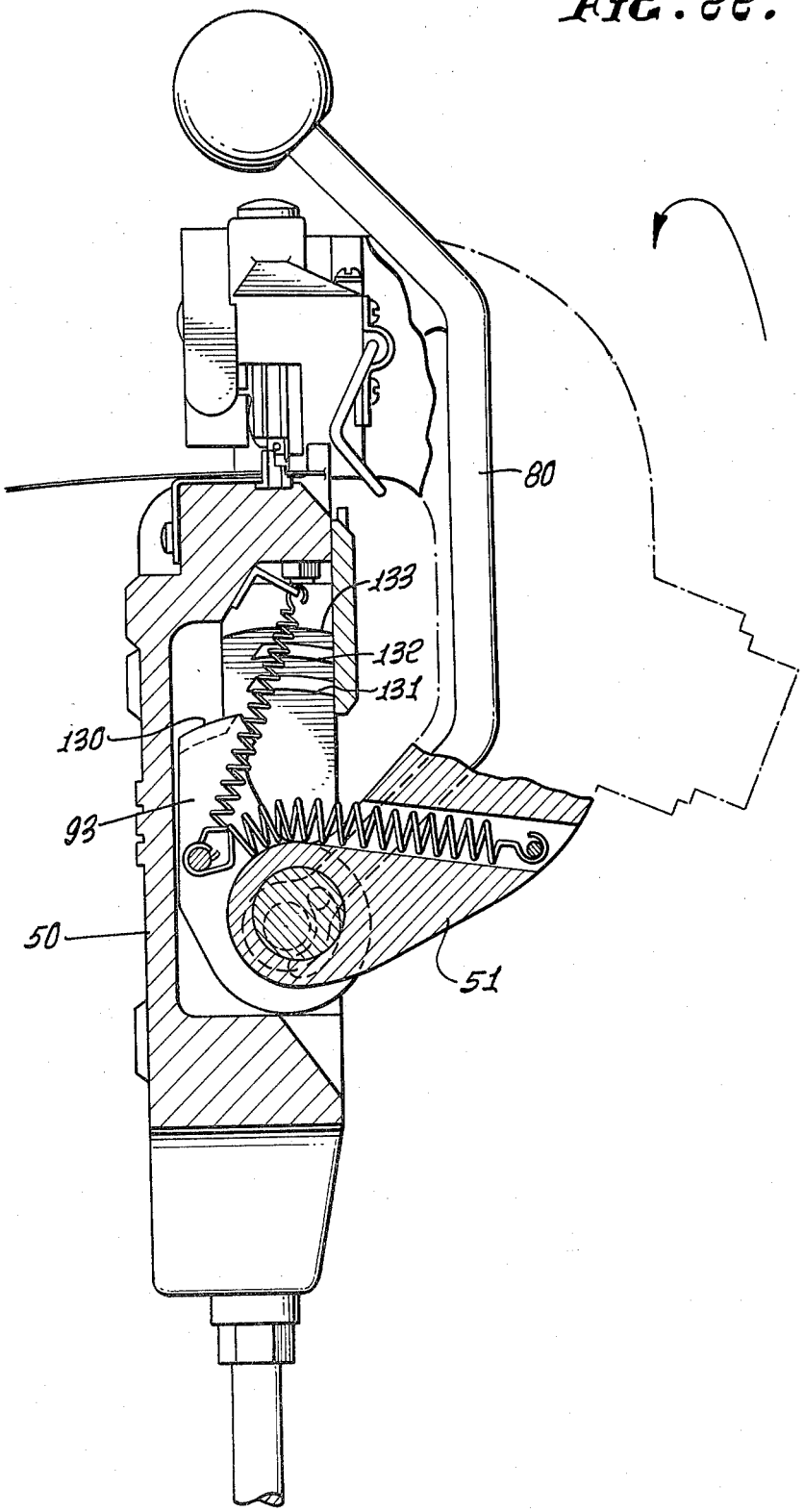
FIG. 22 is a side view similar to that of FIG. 8 showing an alternative embodiment of the invention.
Figure 23:
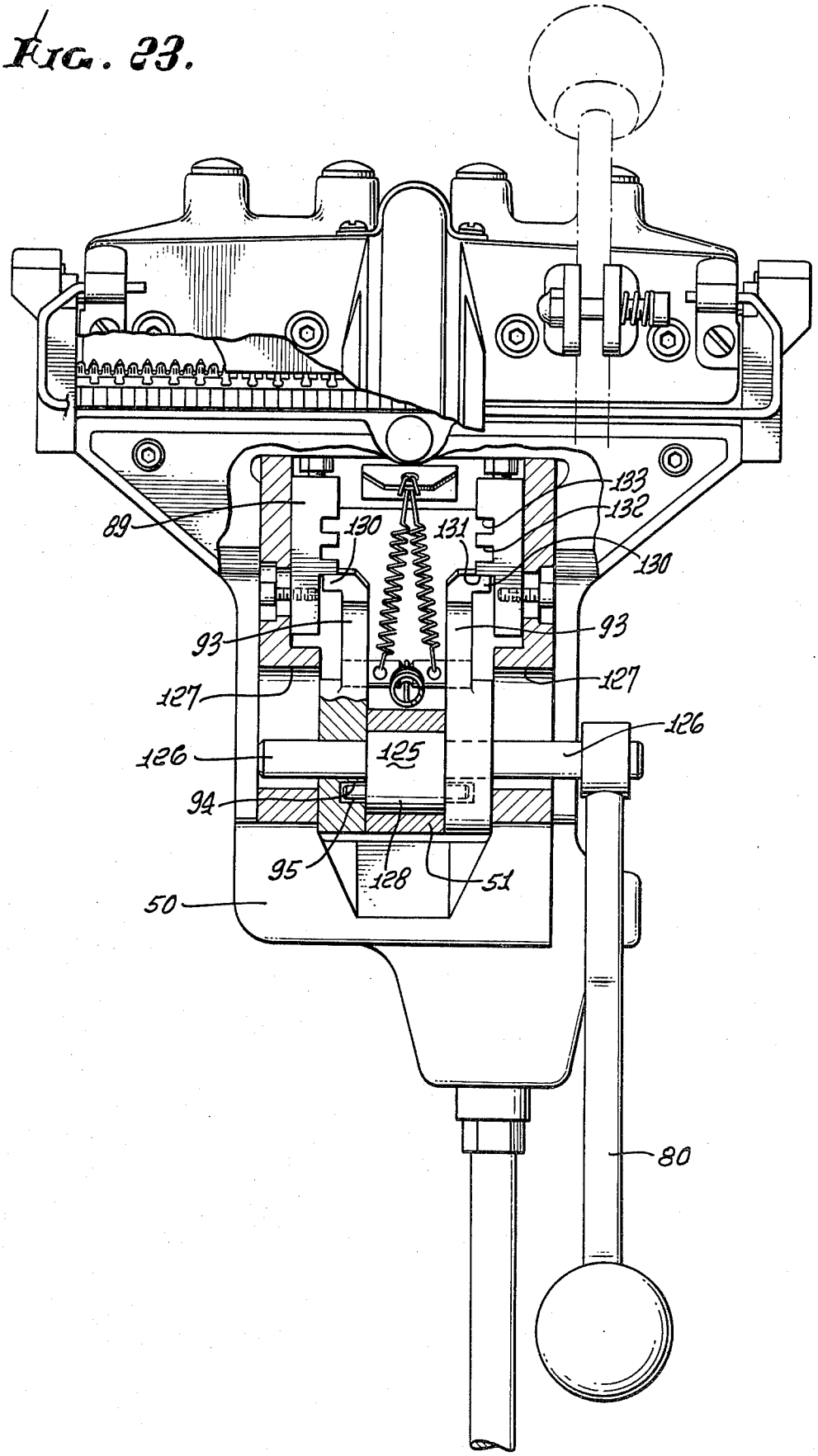
FIG. 23 is a front view similar to that of FIG. 18, showing the tool of FIG. 22.

An alternative embodiment for the cams, dogs and stops is shown in FIGS. 22 and 23. Pin 125 has opposing shafts 126 riding in slots 127 of the body and a central portion 128 in the T-bar. The dogs 93 have arcuate projections 130 at the upper ends thereof for engaging arcuate stop ribs 131, 132, 133 of the stop members 89. The cutter-presser of FIGS. 22 and 23 is operated in the same manner as described for the cutter-presser of FIGS. 1–21.

I claim:

1. In a cutter-presser for the 710 electric cable connector, the combination of:

a body;

a T-bar pivotally mounted on said body and movable upwardly and downwardly relative to said body, said body having spaced T-bar guides engageable by said T-bar;

cam means movable upwardly and downwardly relative to said body and connected to said T-bar for moving said T-bar downwardly in said T-bar guides;

lever means connected to said cam means for pivoting said cam means to move said T-bar upwardly and downwardly relative to said body;

location dog means connected to said cam means and pivotable by said lever means; and a series of first stop means carried on said body and engageable by said dog means in sequence for limiting downward movement of said T-bar in a corresponding series of motions;

said cam means including a shaft with a first circular section mounted in said T-bar, and second and third circular sections mounted in slots in said body, with said slots having straight parallel sides, whereby rotation of said shaft by said lever means moves said T-bar linearly downward relative to said body.

2. In a cutter-presser for the 710 electric cable connector, the combination of:

a body;

a T-bar pivotally mounted on said body and movable upwardly and downwardly relative to said body, said body having spaced T-bar guides engageable by said T-bar;

cam means movable upwardly and downwardly relative to said body and connected to said T-bar for moving said T-bar downwardly in said T-bar guides;

lever means connected to said cam means for pivoting said cam means to move said T-bar upwardly and downwardly relative to said body;

location dog means connected to said cam means and pivotable by said lever means; and a series of first stop means carried on said body and engageable by said dog means in sequence for limiting downward movement of said T-bar in a corresponding series of motions;

with said cam means including a shaft with a first circular section mounted in said T-bar and a second circular section mounted in said body, with said lever means connected to said shaft; and with said dog means including a pair of spaced dogs riding on said shaft, a pin interconnecting said dogs, first spring means interconnecting said pin and body urging said dogs into engagement with said first stop means, second stop means carried on said shaft and engageable with said dogs holding said dogs out of engagement with said first stop means, and second spring means carried between said pin and T-bar urging said T-bar into position at said guides.

3. In a cutter-presser for the 710 electric cable connector, the combination of:

a body;

a T-bar pivotally mounted on said body and movable upwardly and downwardly relative to said body, said body having spaced T-bar guides engageable by said T-bar;

cam means movable upwardly and downwardly relative to said body and connected to said T-bar for moving said T-bar downwardly in said T-bar guides;

lever means connected to said cam means for pivoting said cam means to move said T-bar upwardly and downwardly relative to said body;

location dog means connected to said cam means and pivotable by said lever means; and a series of first stop means carried on said body and engageable by said dog means in sequence for limiting downward movement of said T-bar in a corresponding series of motions;

with said cam means including a shaft with a first circular section mounted in said T-bar and a second circular section mounted in said body, with said lever means connected to said shaft; and with said dog means including a dog riding on said shaft, first spring means urging said dog into engagement with said first stop means, and second stop means carried on said shaft and engagement with said dog holding said dog out of engagement with said first stop means.

4. A cutter-presser as defined in claim 3 wherein said second stop means comprises a pin carried by said shaft and riding in a arcuate slot in said dog.

5. A cutter-presser as defined in claim 3 wherein said first stop means includes first, second and third ledges engageable by said dog when said lever means is pivoted.

6. In a cutter-presser for the 710 electric cable connector, the combination of:

a body;

a T-bar pivotally mounted on said body and movable upwardly and downwardly relative to said body, said body having spaced T-bar guides engageable by said T-bar;

cam means movable upwardly and downwardly relative to said body and connected to said T-bar for moving said T-bar downwardly in said T-bar guides;

lever means connected to said cam means for pivoting said cam means to move said T-bar upwardly and downwardly relative to said body;

location dog means connected to said cam means and pivotable by said lever means; and a series of first stop means carried on said body and engageable by said dog means in sequence for limiting downward movement of said T-bar in a corresponding series of motions; and means for mounting said connector on said body and comprising opposed upstanding guide members, a pair of spaced clips carried on a plate, a shaft mounted in said body for axial and radial movement, and means attaching said plate to said shaft positioning said clips between said upstanding guide members.

7. A cutter-presser as defined in claim 6 including spring means urging said shaft in a first axial direction and shoulder means carried on said body and engageable with said plate when said shaft is moved in the opposite axial direction for deflecting said shaft radially raising said clips from said body.

8. In a cutter-presser for the 710 electric cable connector, the combination of:

a body;

a T-bar pivotally mounted on said body and movable upwardly and downwardly relative to said body, said body having spaced T-bar guides engageable by said T-bar;

cam means movable upwardly and downwardly relative to said body and connected to said T-bar for moving said T-bar downwardly in said T-bar guides;

lever means connected to said cam means for pivoting said cam means to move said T-bar upwardly and downwardly relative to said body;

location dog means connected to said cam means and pivotable by said lever means;

a series of first stop means carried on said body and engageable by said dog means in sequence for limiting downward movement of said T-bar in a corresponding series of motions;

a hub on said lever means; and a knob mounted on said body adjacent said hub for movement between first and second positions, said knob having a recessed portion for sliding movement of said hub thereby when in said first position, with said knob blocking sliding movement of said hub when in said second position.

* * * * *